United States Patent [19]

Burnett

[11] Patent Number: 4,627,150

[45] Date of Patent: Dec. 9, 1986

[54] TOOL FOR INSERTING CABLE WIRES IN CONNECTOR CONTACTS

[75] Inventor: David W. Burnett, Arlington Heights, Ill.

[73] Assignee: AT&T Technologies, Inc., Berkeley Heights, N.J.

[21] Appl. No.: 566,257

[22] Filed: Dec. 28, 1983

[51] Int. Cl.[4] ..... H01R 43/04

[52] U.S. Cl. ..... 29/566.4; 29/566.1; 29/751

[58] Field of Search ..... 29/566.1, 566.3, 566.4, 29/751, 753

[56] References Cited

U.S. PATENT DOCUMENTS

| | | | |
|---|---|---|---|
| Re. 30,848 | 1/1982 | Bauerkemper | 29/749 |
| 3,742,571 | 7/1973 | Brehm | 29/751 |
| 3,838,491 | 10/1974 | Mayberry et al. | 29/750 |
| 4,048,710 | 9/1977 | Nijman | 29/751 |
| 4,137,624 | 2/1979 | Davis et al. | 29/566.1 |
| 4,174,560 | 11/1979 | Senior et al. | 29/566.1 |
| 4,286,381 | 9/1981 | Litehizer, Jr. | 29/751 |
| 4,308,657 | 1/1982 | Anderton | 29/566.3 |
| 4,349,944 | 9/1982 | Fickes | 29/566.4 |
| 4,387,501 | 6/1983 | Rix | 29/566.4 |
| 4,389,769 | 6/1983 | Casey | 29/753 |
| 4,467,516 | 8/1984 | John et al. | 29/566.4 |

*Primary Examiner*—Gil Weidenfeld
*Assistant Examiner*—Daniel W. Howell
*Attorney, Agent, or Firm*—Peter Visserman; M. DePicciotto

[57] ABSTRACT

A connector 14 with rows of contacts 12 is placed in a holder carriage 22 which is loaded into a wire insertion tool 10. Insertion blades 56 and 57 are moved by a trigger mechanism 17 to insert a pair of wires 11 into two contacts whereupon the blades act to sever excess sections of the wires at points closely adjacent to the contacts. Upon release of the trigger 17, an index mechanism 23 is operated to move the holder carriage 22 and the connector to position the next two contacts in alignment with the insertion blades 56 and 57.

1 Claim, 14 Drawing Figures

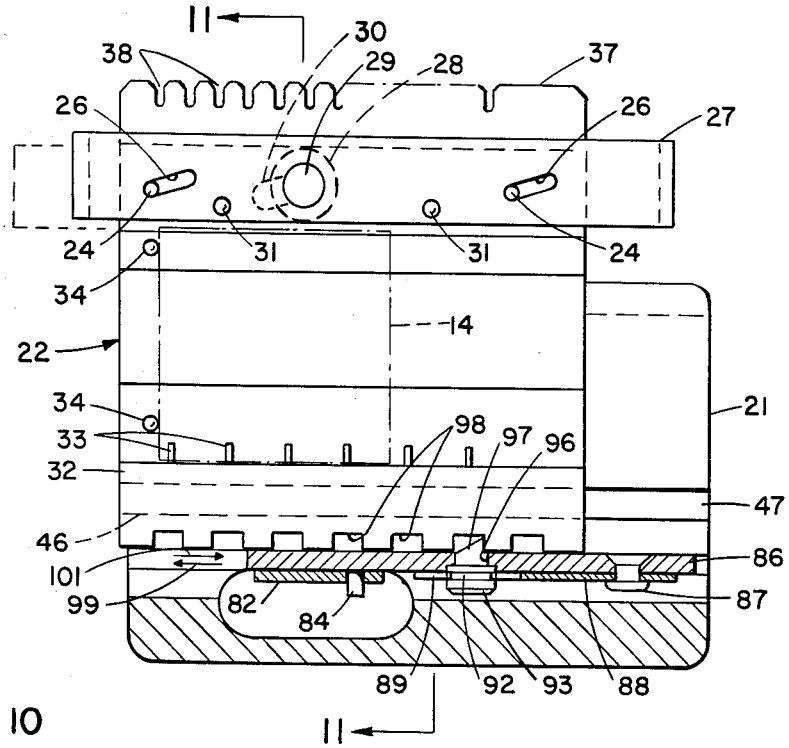
FIG. 10
FIG. 11
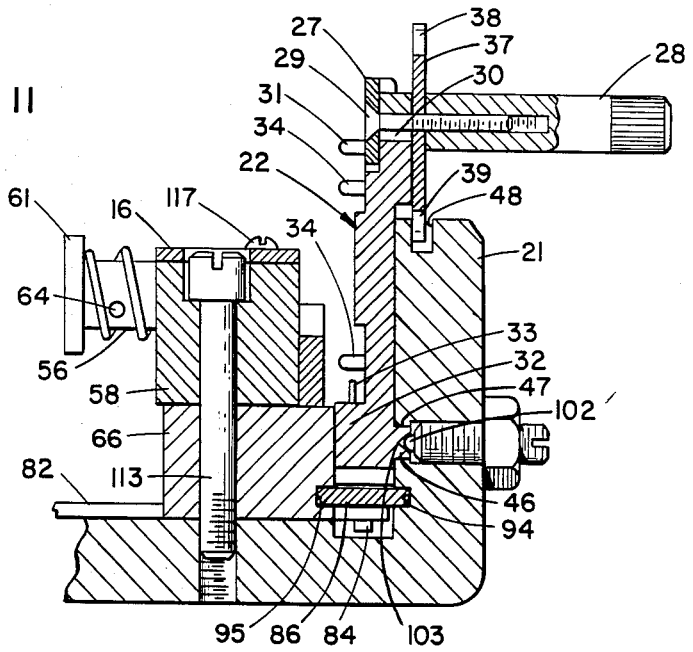

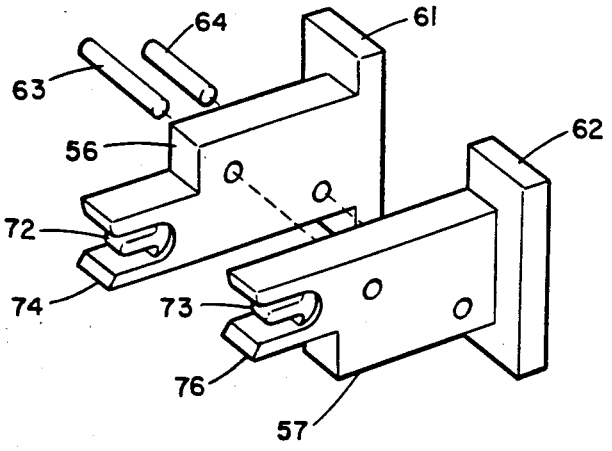
FIG. 12
FIG. 13
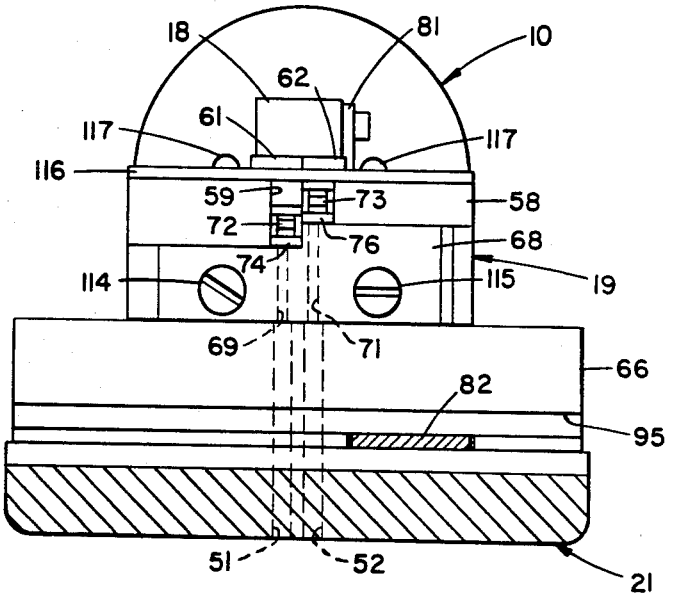
FIG. 14
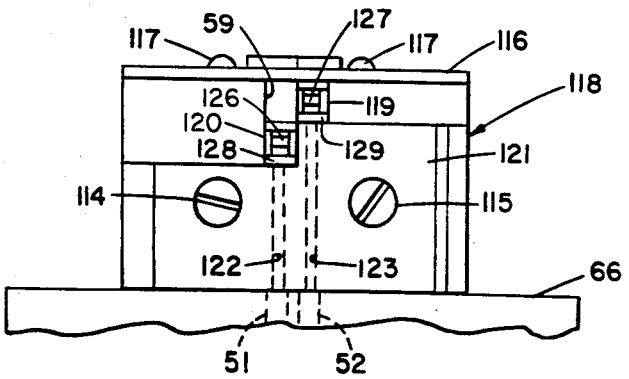

TOOL FOR INSERTING CABLE WIRES IN CONNECTOR CONTACTS

TECHNICAL FIELD

This invention relates to a hand tool for sequentially inserting wires into a bank of contacts mounted in an electrical device, such as a connector; and is more particularly concerned with a trigger operated hand tool for inserting insulated wires into a bank of insulation piercing contacts arrayed in rows and columns in a connector.

BACKGROUND OF THE INVENTION

Multi-wired cables are often connectorized at opposite ends for use in providing interconnections between discrete modules of an electronic equipment, or interconnections between separate equipments. Such connectorized cables are extensively employed in the manufacture of various telephone equipments. In one type of connector, an array of terminations or contacts are arranged in columns and rows with each column comprising a pair of spaced terminations formed as projections extending from an elongated flat terminal. The projecting portions or bights are longitudinally slotted to receive insulated wires. When an insulated wire is forced into a slotted termination the edges of the slot penetrate the insulation of the wire to bite into the metallic core wire to establish an electrical contact.

In copending patent application Ser. No. 547,532, filed on Oct. 31, 1983, in the names of H. H. Bower-E. F. Kulka, there is disclosed a bench mounted machine for use in a factory to assemble successive pairs of insulated wires in connector terminations of the type heretofore described. There is a need in the field, or at equipment installation sites, for a portable, hand operated tool that may be used to assemble insulated wires in connector terminations. There are many existing hand tools that assemble a group of wires into insulation piercing contacts. These tools may be of a lever operated type and function to move a head to insert a group of parallel wires into a group of contacts which are commonly aligned in a single row. When a large group of wires are to be inserted in contacts, the wires are usually separated into subgroups, and each subgroup is manually positioned to overlay a subgroup of insulation piercing contacts. The tool is operated to seat the first subgroup of wires, and then the connector is manipulated to position a second subgroup of contacts to receive the next subgroup of wires. The use of such tools requires considerable skillful and dexterous handling to accurately position the wires and the connector with respect to the insertion head.

SUMMARY OF THE INVENTION

The present invention contemplates among other things, a hand operated tool for inserting pairs of wires into a succession of pairs of insulation piercing contacts mounted in a connector, together with facilities for successively indexing the connector to present succeeding pairs of terminations to a wire insertion head.

More particularly, a hand operated tool is provided so that the depression of a trigger like lever causes a ram to move toward a wire insertion site. Mounted on the ram are a pair of insertion blades that engage a pair of wires dressed to overlay a pair of insulation piercing contacts. Continued squeezing of the trigger lever causes the insertion blades to push the wires into a pair of aligned insertion piercing contacts. The blades are provided with shearing sections that function to cut excess portions of the wires at positions closely adjacent to the contacts. Upon release of the trigger lever, an index mechanism is rendered effective to advance a holder carriage to move the connector to position a subsequent pair of contacts at the insertion site. With this tool construction, a large number of wires can be successively inserted as subgroups of wires into subgroups of contacts in a connector with only a moderate expenditure of force and a minimum amount of manipulation by the user.

DESCRIPTION OF DRAWING

Other advantages and features of the invention will become apparent upon consideration of the following detailed description in conjunction with the drawing, wherein:

FIG. 10 is a sectional view taken along line 10—10 of FIG. 2 further illustrating the instrumentalities for indexing the holder carriage together with a showing of a set of pins for retaining a connector in the holder carriage;

FIG. 11 is a partial sectional view taken along line 11—11 of FIG. 10 showing the details of the holder carriage mounted in the tool together with a number of locator pins projecting from the carriage to define a nest for receiving and positioning a connector;

FIG. 12 is a perspective view of a pair of wire insertion blades having wire cutting edges which function to cut the wires at points closely adjacent to the terminations;

FIG. 13 is a front view of the wire insertion blades showing a vertical displacement of the blades so as to insert two wires into two spaced rows of terminations; and FIG. 14 is a front view similar to FIG. 13 in which the insertion blades have been replaced by a second set of blades to insert pairs of wires in terminations arranged in different rows.

DETAILED DESCRIPTION

Figure 1:
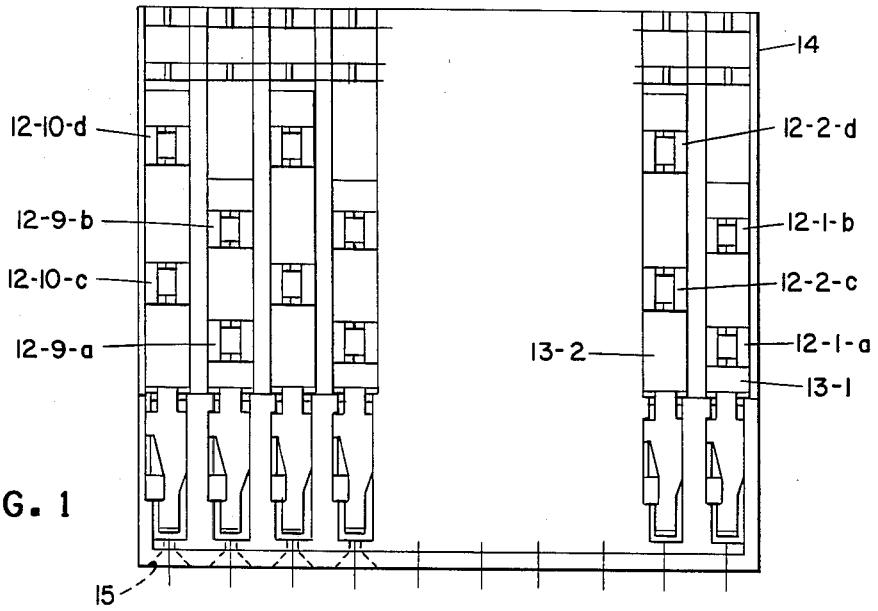
FIG. 1 is a plan view of a connector having a coordinate array of insulation displacement terminations into which pairs of wires may be successively inserted by the tool of the present invention.
Figure 6:
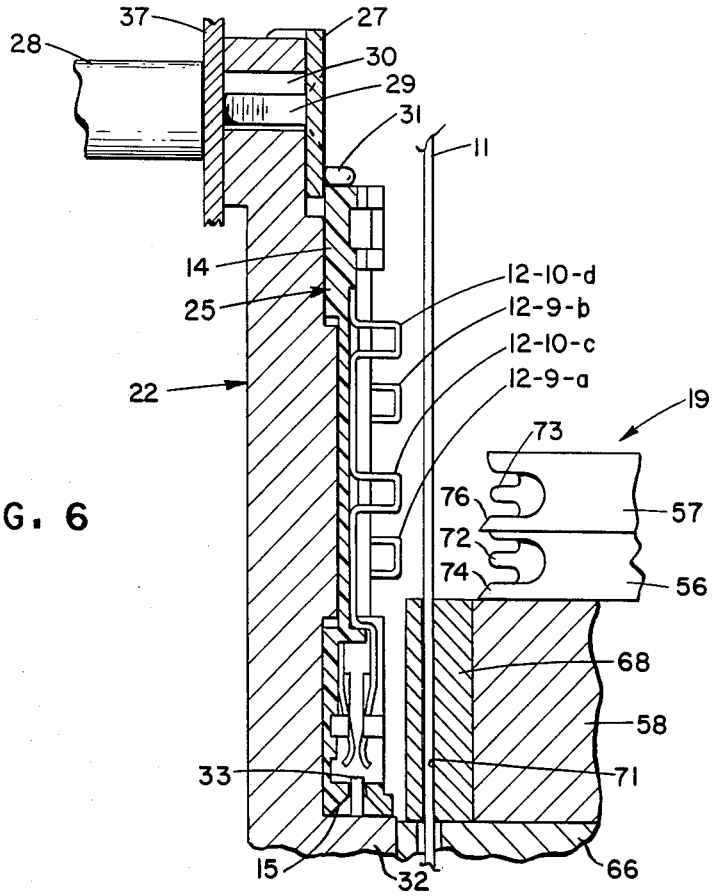
FIG. 6 is a enlarged sectional view showing the relation between the connector terminations and the wire insertion blades.

The tool 10 (see FIG. 2) forming the subject matter of the present invention is designed to insert pairs of insulated cable wires 11 into pairs of insulation piercing terminations or contacts 12 formed on adjacent pairs of terminals 13 mounted in a connector 14 (see FIGS. 1 and 6). As will be noted from inspection of FIG. 1, the terminals 13-1, 13-2, etc. are in parallel relation and the contacts, e.g. contacts 12-2-*c*, 12-1-*a*, 12-2-*d* and 12-1-*b*, are arranged in four rows and a number of columns e.g. 10. The connector is formed with socket holes 15 for receiving prong-like terminals of a mating connector (not shown). Each contact 12 is in a form of bight projecting from a terminal and is provided with a longitudinal cut out section to receive an insulated wire. The sides of the cut out sections are spaced apart a distance less than the diameter of the insulated wire. When a wire 11 is pushed into a contact, the edges of the cut out section bite through the insulation and into the metallic wire.

Figure 5:
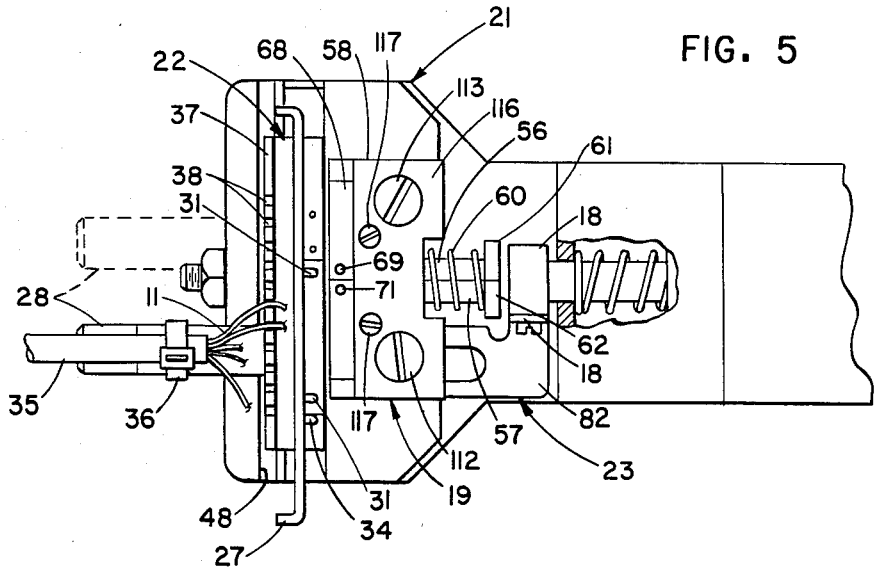
FIG. 5 is a partial top view of the tool shown in FIG. 2 particularly illustrating a ram for driving insertion blades to seat a pair of wires in a pair of insulation piercing terminations.

Essentially, the tool 10 (see FIGS. 2 and 5) comprises a trigger 17 for operating a spring loaded ram 18, a cutting die and wire insertion blade assembly 19 slideably mounted in a housing or U-shaped frame 21, a removable connector holder carriage 22 and an indexing mechanism 23 for stepping the holder carriage through an insertion site following each insertion of a pair of wires 11. The trigger operated spring loaded ram 17–18 may be any of a number of commercial termination tools e.g. a #MCT termination tool sold by the Panduit Co. of Tinley Park, Ill.

Figures 2, 3:
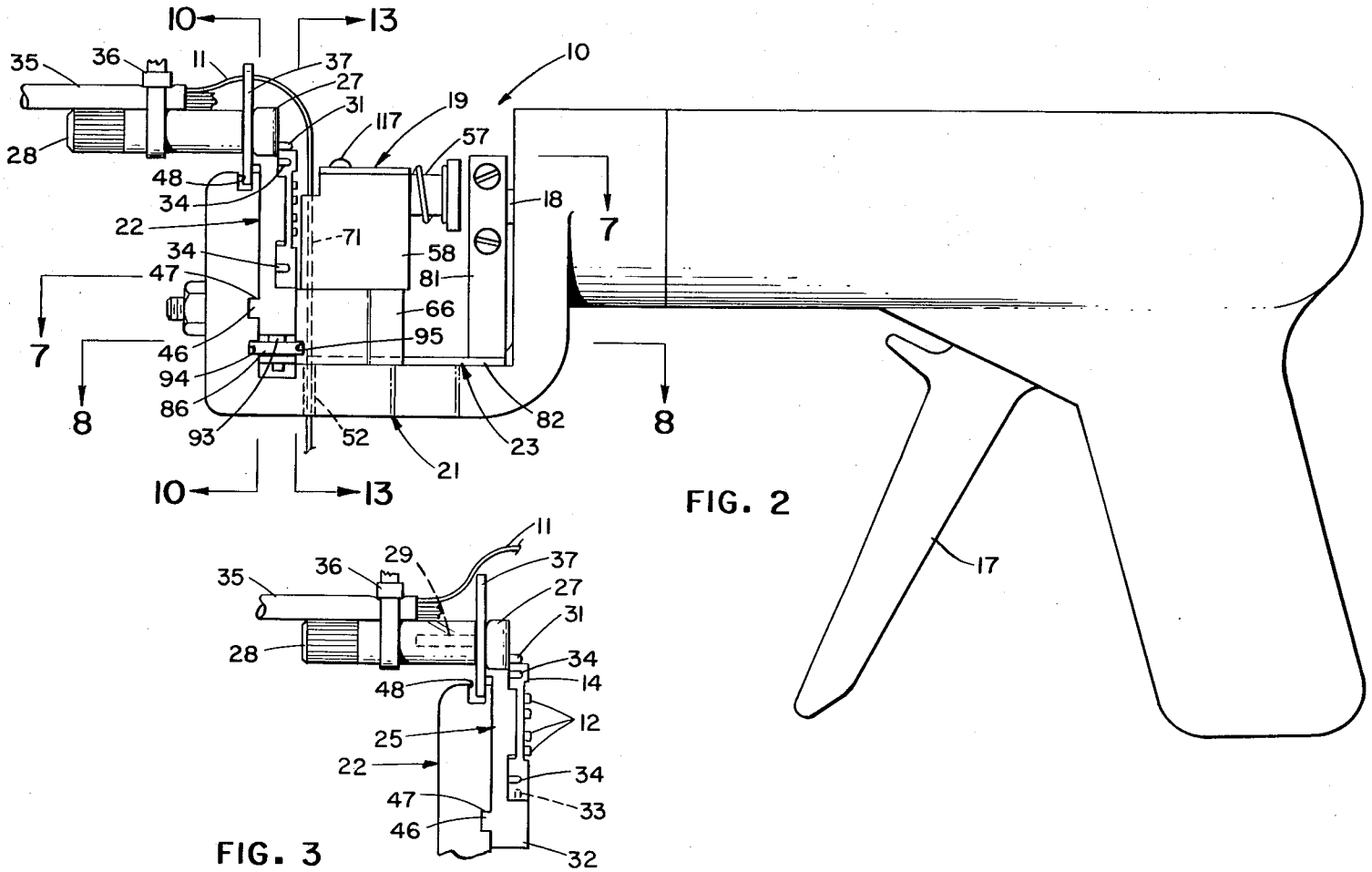
FIG. 2 is a side view of a hand tool for inserting wires into terminations of a connector of the type shown in FIG. 1 and which embodies the principles of the present invention.
FIG. 3 is a side view of a holder carriage for receiving a connector and which is adapted to be mounted in and indexed by the tool shown in FIG. 2.

In use, the holder carriage 22 is removed from the tool and a connector 14 is placed in a nest 25 formed in the removed carriage (see FIGS. 3 and 6). The carriage 22 (see FIG. 10) is provided with a pair of pins 24 extending into a pair of angular slots 26 formed in a slideably mounted hold down blade 27. The hold down blade provides a mounting for a cable holding post 28. Post 28 is knurled at one end and formed with a threaded bore on the other end to receive a threaded stud 29 seated in the blade 27. The threaded stud 29 extends through an angular slot 30 (see FIG. 10) formed in an upper section of the holder carriage 22. By turning the knurled end, the post 28 may be released from a blade clamping position to allow the blade 27 to be moved up to receive the connector. The blade is provided with a pair of hold down pins 31 (see FIGS. 3 and 10) that are subsequently moved with the blade to bear against the top of the connector 14. The holder carriage is further provided with a protuberant section 32 for mounting upwardly extending pins 33 which are received in socket holes 15 formed in the connector. In addition the holder carriage mounts a pair of horizontally extending reference pins 34 which are provided to abut the side edge of the connector.

Figure 4:
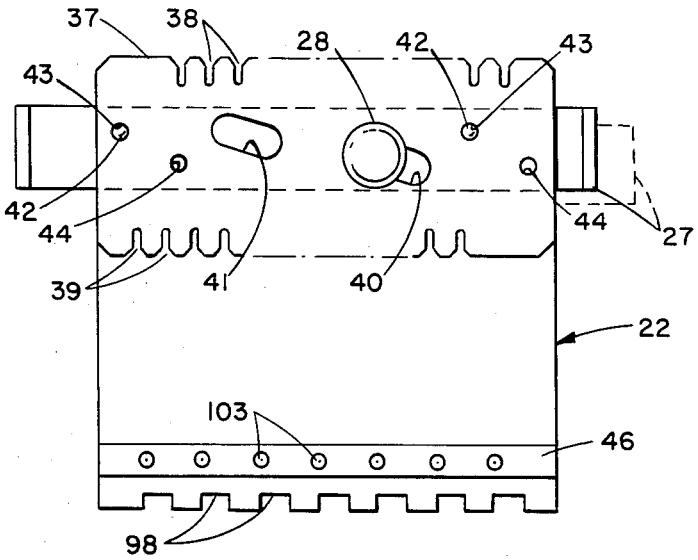
FIG. 4 is a front view of the holder carriage showing index notches and a hold down blade for securing a connector in the carriage.

To load a connector, the post 28 is turned to release the blade 27 which is then shifted angularly to the left as viewed in FIG. 4 or to right as viewed in FIG. 10 from the dashed line to the solid line position, whereupon the pins 24 react against the walls of the slots 26 to move the clamp blade 27 in an upwardly direction thus allowing a connector 14 to be placed in the carriage nest 25 with the pins 33 received within the connector socket holes 15 and the side edge of the connector abutted against the reference pins 34. After the connector is positioned in the carriage nest, the post 28 and blade 27 are slid to the right as viewed in FIG. 4 to left as viewed in FIG. 10 to move the blade downwardly to move the pair of pins 31 mounted thereon into engagement with the top of the connector 14. At this time, the knurled end of the post 28 is turned to lock the blade 27 in the connector holding position. Now, the user may secure a cable 35 with unsheathed insulated wires 11 to the post 28 by means of a tie 36.

A dressing plate 37 (see FIG. 4) having wire receiving slots 38 and 39 is releasably secured by the post 28 which overlays the edges one or another of a pair of angular slots 40 or 41. The dressing plate may be removed and reversed to present slots 39 to receive the wires 11 when different gauge wires are used. The dressing plate is also held in position by locator dowels 42 mounted in the upper front face of holder carriage 22 so as to extend into one or the other of two pairs of holes 43 or 44 formed in the dressing plate.

Next, the user mounts the holder carriage 22 in the frame 21 of the tool 10 by placing a transversely extending flange 46 formed thereon in a slot 47 (see FIGS. 2 and 10) machined in a forward portion of the frame 21. From inspection of FIGS. 2 and 5, it will be noted that during loading of the holder carriage, the bottom of the dressing plate 37 is fitted within a transverse slot 48 running along the top front end of the housing 21 and thus acts to retain the holder carriage in the housing.

A pair of wires 11 to be inserted in the insulation piercing contacts are laid in dressing plate slots 38 and positioned to overlay a pair of adjacent insulation piercing contacts 12 (e.g. contacts 12-1-*a* and 12-2-*c*) at the insertion site. The forward ends of the wires are pushed to extend through a pair of holes 51 and 52 (see FIGS. 2 and 13) formed in a bottom section of the housing 21.

Figure 7:
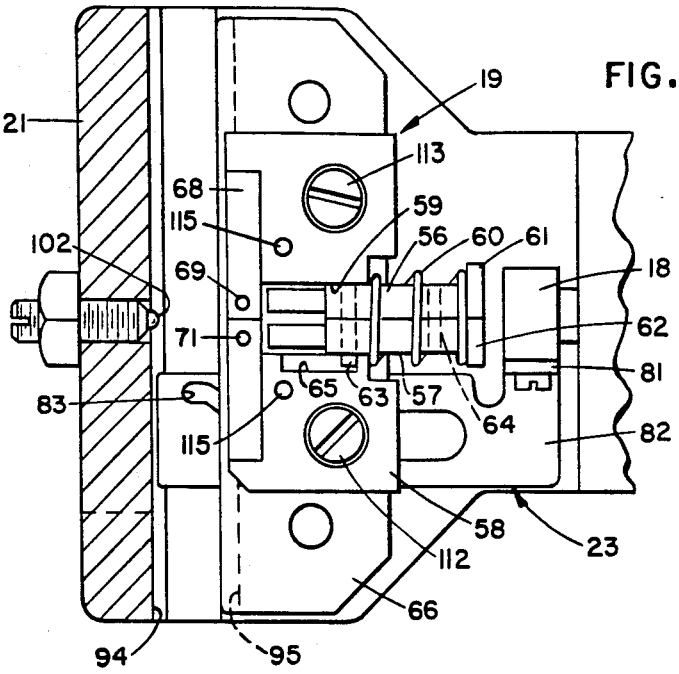
FIG. 7 is a sectional view taken along line 7—7 of FIG. 2 showing instrumentalities for indexing the holder carriage and a ball check for retaining the holder carriage in each indexed position.

Insertion of wires into the contacts is accomplished by the movement of a pair of insertion blades 56 and 57 (see FIGS. 6, 7, 12 and 13) slideably mounted in a die receiving block 58 of the cutting die and wire blade assembly 19. The blades are slideably mounted in a slot 59 formed in the die receiving block and are held from extending through the die block by a spring 60 which bears against flanges 61 and 62 formed on the ends of the blades. The blades 56 and 57 are held together by a pair of pins 63 and 64. Pin 63 projects from the assembled blades and rides in a slot 65 (FIG. 7) formed in the die receiving block 58 to limit the reciprocating movement of the insertion blades. The die receiving block is fastened to a bolster 66 (FIGS. 2, 11 and 13) secured to the housing 21. The die receiving block 58 also mounts a stepped die insert plate 68 having a pair of wire receiving holes 69 and 71 (see also FIG. 5) that are aligned with the holes 51 and 52 formed in the frame 21. The wires are initially passed through the holes 69 and 71 and then through the holes 51 and 52. When the trigger operated ram 18 advances, the flanges 61 and 62 of the blades 56 and 57 are engaged by the ram 18 to move the blades against the spring 60 so that a pair of insertion tips 72 and 73 (see FIGS. 6 and 12) push the wires into the pair of aligned insulation piercing contacts 12 at the insertion site. When the blades 56 and 57 move forward, a pair of beveled shear tips 74 and 76 move along the stepped surfaces of the insert plate 68 and then against the sections of wires entering the die holes 69 and 71 to shear the wires at positions closely adjacent to the contacts.

Following each insertion of a pair of wires 11 into a pair of adjacent contacts 12, the trigger 17 is released to withdraw the ram 18 allowing the spring 60 to restore the insertion blades. The lower sheared sections of the wires 11 either drop or are pulled from the insertion tool. Upon release of the trigger 17, the holder carriage is indexed to present the next pair of contacts 12 to the insertion blades 56 and 57.

Figure 9:
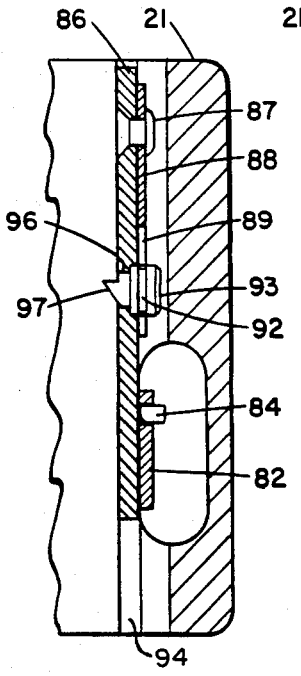
FIG. 9 is a sectional view taken along line 9—9 of FIG. 8 depicting an index slide and an index detent for incrementally advancing the holder carriage.
Figure 8:
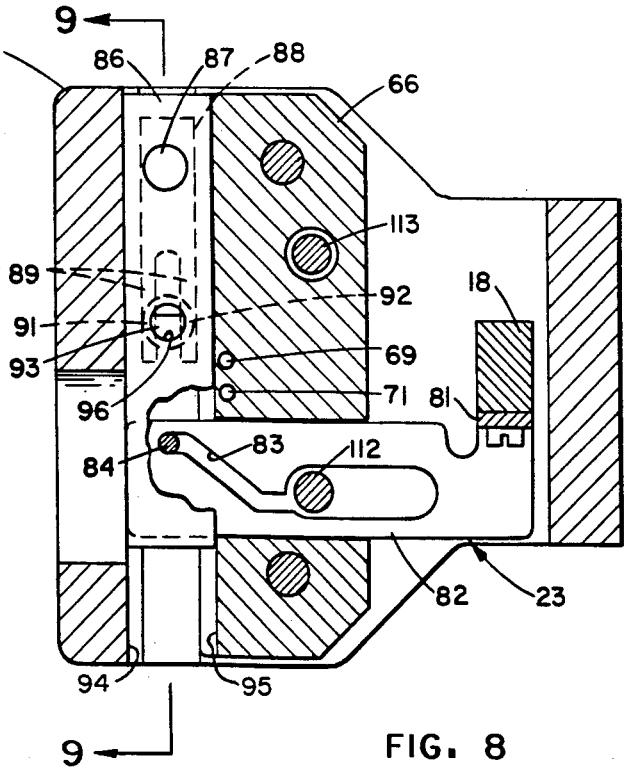
FIG. 8 is a sectional view taken along line 8—8 of FIG. 2 showing the details of the carriage indexing instrumentalities.

The indexing mechanism 23 (see FIGS. 7, 8 and 9) includes an arm 81 depending from the ram 18 and has integrally formed therewith a horizontally extending cam slide plate 82. Cam plate 82 is formed with an inclined cam slot 83 into which extends a cam follower pin 84 depending from a slide plate 86. Secured by a rivet 87 to the slide plate 86 is a leaf spring 88 having a bifurcated end 89 subtending parallel flats 91 and 92 (see FIG. 8) formed on an index pin 93. As shown in FIGS. 2 and 11, the slide plate 86 is mounted in guideways 94 and 95 formed respectively in housing 21 and bolster 66.

Resiliently urged index pin 93 extends through a hole 96 (see FIG. 10) formed in the slide plate 86 and is provided with a beveled tip 97 adapted to fit within notches 98 (see also FIG. 2) formed on the underside of the holder carriage 22.

When the ram 18 moves forward (see FIG. 8), the slide plate 82 also moves to advance the cam slot 83 which reacts against the cam follower pin 84 to move the slide plate 86 in a direction indicated by arrow 99 in FIG. 10. The beveled tip 97 of the index pin cams against the edge of a notch 98 to withdraw the index pin. The index pin is thereafter moved into alignment with the next notch 98 and the flat spring 88 forces the index pin to enter this notch. Upon release of the trigger 17, the ram 18 is withdrawn to slide the cam plate 88 so that the cam slot 83 acts against the cam follower pin 84 to move the index slide in the direction of arrow 101 (see FIG. 10). The index pin 93 engaged within a notch 98 advances the holder carriage 22 a distance sufficient to move the next pair of contacts 12 into the insertion site in alignment with the insertion blades 56 and 47 in anticipation of the loading and seating of the next pair of wires. The holder carriage is releasably held in each advanced post by a spring loaded ball check 102 (see FIG. 11) which seats in detent notches 103 formed in the flange 37 (see FIG. 4) projecting from the side of the holder carriage 22.

In summary of the use of the tool, the holder carriage 22 is removed from the tool and loaded with a connector 14 and a cable 35 with the cable wires 11 is secured by a tie 36 (see FIG. 3) to the cable holding post 28. The holder carriage is placed in the tool with the flange 46 slidably seated in the guide slot 47 (see FIG. 11) and the lower section of the dressing plate 37 fitted within the transverse slot 48. A selected pair of wires are placed in appropriate dressing blade slots 38 (see FIG. 2) and the wire ends are passed through the die holes 69 and 71 and the housing holes 51 and 52. The wires are held taut with one hand while the user's other hand operates the trigger 17 to advance the wire insertion and shearing blades 56 and 57 into the insertion site to seat the wires in the connector contacts 12 which cut into the wire insulation and bite into the metal wires. The beveled forward ends 74 and 76 of the moving blades 56 and 57 shear the wires against the entry edges of the die holes 69 and 71. The sheared ends of the wires drop or are pulled from the holes 51 and 52. Upon release of the trigger, the indexing mechanism 23 functions to advance the holder carriage 22 to present the next pair of contacts 12 to the wire insertion and shearing blades; whereafter, the user grasps the next pair of wires and dresses these wires in the next pair of dresser slots 38. The ends of the dressed wires are pushed through the aligned holes 69, 71 and 51, 52 and the tool is ready to insert these wires in the next pair of contacts.

With it is desired to insert pairs of wires in the upper two rows of contacts, e.g. starting with contacts **12-1-*b* and 12-2-*d*, a pair of recessed shoulder screws 112 and 113 (see FIGS. 5, 7 and 8) are removed thus allowing removal of the insertion blade assembly 19 (see FIG. 13) from the support bolster 66. This blade assembly 19 comprises the blades 56 and 57 held by the pins 63 and 64, the die receiving block 58, the die insert plate 68 held by a pair of shoulder screws 114 and 115, a cover plate 116 held by a pair of screws 117. A second die assembly 118 (see FIG. 14) is placed on the bolster 66 and secured thereto by the shoulder screws 112 and 113. This die and blade assembly 118 differs from die and blade assembly 19 in that a second set of insertion blades 120 and 119 and a second stepped insert plate 121 with a pair of longer wire receiving holes 122 and 123 are assembled on a slotted block substantially indentical to block 58**.

It will be noted from a comparison of FIGS. 13 and 14 that a pair of insertion tips 126 and 127 of blades 120 and 119 are at a higher elevation than the insertion tips 72 and 73 on the blades 56 and 57. The insertion tips 126 and 127 are adapted to move into a now, higher insertion site at a level to push wires 11 into the top rows of contacts, such as contacts **12-1-*b* and 12-2-*d*. The insert plate 121 is of greater height then the insert plate 68, hence, leading sections of the wires placed in holes 122 and 123 will be sheared by a pair of shear tips 128 and 129** in close proximity to the contacts in the upper two rows.

What is claimed is:

1. A hand tool for inserting wires into contacts of an electrical device, which comprises:

a frame formed with a first and a second elongated open slot;

a holder slideably mounted in said frame for supporting the electrical device with a pair of its contacts positioned in an insertion site;

a block assembly mounted in said frame and including a first slot formed therein, a plate having a stepped surface, and a pair of holes extending from said stepped surface for receiving a pair of wires to be inserted in a pair of contacts of the device;

a pair of adjacent vertically displaced insertion blades slideably mounted in said first slot of the block assembly and adapted to ride on said stepped surface during their movement toward and away from the insertion site, each of said insertion blades having a first tip section for exerting a force against a wire and a second tip section for shearing a wire;

a trigger operated means for simultaneously moving the insertion blades into the insertion site to force the pair of wires interposed between the insertion blades and the pair of contacts into engagement with the contacts and to shear said wires in said holes at points adjacent to the contacts in which the wires are inserted upon depression of the trigger operated means;

means operated by the release of the trigger operated means for indexing the holder to move the next pair of contacts into the insertion site; and a dressing plate detachably mounted on said holder and having one edge formed with a series of wire receiving slots and the other edge fittable within said first elongated open slot for guiding said holder to move transversely of said insertion blades, said holder being formed with a transversely extending flange slidably mounted in said second slot for guiding said holder during said transverse movements.

* * * * *